US005894190A

United States Patent [19]

Hirota et al.

[11] Patent Number: 5,894,190

[45] Date of Patent: Apr. 13, 1999

[54] COLOR CATHODE RAY TUBE HAVING A LARGE-DIAMETER LENS

[75] Inventors: Katsumi Hirota; Tetsuo Asano, both of Mobara; Nobuyuki Suzuki, Isumi-gun; Yasuo Tanaka; Hiroshi Nakamoto, both of Mobara, all of Japan

[73] Assignee: Hitachi, Ltd., Tokyo, Japan

[21] Appl. No.: 08/821,540

[22] Filed: Mar. 21, 1997

[30] Foreign Application Priority Data

Mar. 22, 1996 [JP] Japan ..... 8-66159
Aug. 16, 1996 [JP] Japan ..... 8-216349

[51] Int. Cl.[6] ..... H01J 29/48; H01J 29/50; H01J 29/62

[52] U.S. Cl. ..... 313/409; 313/417; 313/446; 313/448; 313/449; 313/451; 313/456

[58] Field of Search ..... 313/409, 417, 313/446, 448, 449, 451, 456

[56] References Cited

U.S. PATENT DOCUMENTS

| | | | |
|---|---|---|---|
| 4,271,374 | 6/1981 | Kimura . | |
| 4,728,846 | 3/1988 | Yasuda | 313/451 |
| 4,904,898 | 2/1990 | Penird et al. | 313/449 |

FOREIGN PATENT DOCUMENTS

| | | |
|---|---|---|
| 57-196455 | 12/1982 | Japan . |
| 60-35459 | 3/1985 | Japan . |
| 61-90153 | 6/1986 | Japan . |
| 61-273836 | 12/1986 | Japan . |
| 62-145632 | 6/1987 | Japan . |
| 1-258346 | 10/1989 | Japan . |
| 4-106844 | 4/1992 | Japan . |
| 5-2998 | 1/1993 | Japan . |
| 5-28932 | 2/1993 | Japan . |

*Primary Examiner*—Nimeshkumar D. Patel
*Attorney, Agent, or Firm*—Antonelli, Terry, Stout & Kraus, LLP

[57] ABSTRACT

A cathode ray tube is provided with an electron gun having an electron lens including a large-diameter cylinder electrode and a small-diameter cylinder electrode composed of a large-diameter cylinder portion and a small-diameter cylinder portion, and at least the large-diameter cylinder portion of the small-diameter cylinder electrode is inserted in the large-diameter cylinder electrode thereby forming the electron lens. The small-diameter cylinder portion extending in the tube axis direction of the large-diameter cylinder electrode and connected to the large-diameter cylinder electrode is expanded or bulged, or the bottom portion of the large-diameter cylinder electrode is removed while only the electrode support portion connected to the large-diameter cylinder electrode is left, so that the electrode support fixed to the outer surface of the small-diameter cylinder portion of the small-diameter cylinder electrode can pass therethrough.

12 Claims, 15 Drawing Sheets

COLOR CATHODE RAY TUBE HAVING A LARGE-DIAMETER LENS

BACKGROUND OF THE INVENTION

The present invention relates to cathode ray tubes, and more specifically relates to a cathode ray tube with an electron gun wherein an electron gun diameter is enlarged and productivity is high and high precision assembly is possible.

In cathode ray tubes, particularly a high brightness cathode ray tube such as a projection type cathode ray tube, a current of an electron beam projected to a phosphor screen is made larger and acceleration voltage to be applied to the final accelerating electron is made higher and also potential of a focus electrode is made higher, thereby an image of high brightness and high definition is formed on the phosphor screen.

In order to reduce aberration of an electron beam, it has been tried to increase a diameter of a final accelerating electrode as large as possible within a range limited by an inner diameter of a neck portion.

As an electron gun wherein an electron lens diameter is enlarged, for example, that having a structure disclosed in U.S. Pat. No. 4,271,374 (corresponding to JP-B 58-31696) is used.

FIG. 23 is a side view with essential portions cutaway explaining an electron gun disclosed in U.S. Pat. No. 4,271,374 as above described, and FIG. 24 is a side view with essential portions cutaway of the electron gun in FIG. 23 rotated by 90 degrees around the tube axis direction Z—Z.

In FIGS. 23 and 24, numeral 1 designates a first grid (control electrode), numeral 2 designates a second grid, numeral 3 designates a third grid, numeral 4 designates a fourth grid (small-diameter cylinder electrode), numeral 5 designates a fifth grid (large-diameter cylinder electrode), numeral 6 designates a beading glass, and numeral 7 designates a weld portion. Also numeral 11 designates an electrode support of the first grid 1, numeral 21 designates an electrode support of the second grid 2, numeral 31 designates an electrode support of the third grid 3, numeral 41 designates a support of the small-diameter cylinder electrode 4, numeral 51 designates a support of the large-diameter cylinder electrode 5, numeral **4*a* designates a large-diameter cylinder portion of the fourth grid 4, numeral 4*b* designates a small-diameter cylinder portion of the fourth grid 4, numeral 4*b*-1 designates a first split cylinder portion of the small-diameter cylinder portion 4*b*, numeral 4*b*-2 designates a second split cylinder portion of the small-diameter cylinder portion 4*b*, numeral 5*a* designates a large-diameter cylinder portion of the fifth grid 5, and numeral 5*b* designates a small-diameter cylinder portion of the fifth grid 5. In addition, although not shown, a cathode structure is housed within the fifth grid 1**.

The electron gun of this type is provided with a main lens comprising the large-diameter cylinder electrode 5 composed of the large-diameter cylinder portion **5*a* and the small-diameter cylinder portion 5*b*, and the small-diameter cylinder electrode 4 composed of the large-diameter cylinder portion 4*a* and the small-diameter cylinder portion 4*b*. The large-diameter cylinder portion 4*a* of the small-diameter cylinder electrode 4 is inserted in the large-diameter cylinder electrode 5, and the electrode support 51 fixed on the outer surface of the small-diameter cylinder 5*b* of the large-diameter cylinder electrode 5 and the electrode support 41 fixed on the outer surface of the small-diameter cylinder electrode 4 are embedded in the molten beading glass 6 and fixed so that both electrodes are in desired spaced relationship. In addition, also the first, second and third grids 1, 2, 3 are fixed by embedding the electrode supports 11, 21, 31 of the grids 1, 2, 3 into the molten beading glass 6**.

In the electron gun of this type since a diameter of the large-diameter cylinder portion **4*a* of the small-diameter cylinder electrode 4 is made larger than that of the small-diameter cylinder portion 5*b* of the large-diameter cylinder electrode 5**, the effective lens diameter is increased and high resolution is obtained.

In the electron gun as described above, a diameter of the large-diameter cylinder portion **4*a* of the small-diameter cylinder electrode 4 is larger than that of the small-diameter cylinder portion 5*b* of the large-diameter cylinder electrode 5, and a distance between ends of a pair of electrode supports 41 fixed diametrically opposed on the outer surface of the small-diameter cylinder electrode 4 is larger than a diameter of the small-diameter cylinder portion 5*b* of the large-diameter cylinder electrode 5**.

FIG. 25 is a sectional view taken on XXV—XXV of FIG. 23 explaining the mutual positional relationship of the large-diameter cylinder electrode 5 and the small-diameter cylinder electrode 4, and FIG. 26 is an explanation diagram of an assembling work of the large-diameter cylinder electrode 5 and the small-diameter cylinder electrode 4.

That is, since a distance between ends of the supports 41 of the small-diameter cylinder electrode 4 is larger than a diameter of the small-diameter cylinder portion **5*b* of the large-diameter cylinder electrode 5, in the assembly of the electron gun, electrodes other than the first split cylinder portion 4*b*-1 constituting the small-diameter cylinder electrode 4 are fixed by embedding the electrode supports 11, 21, 31, 41 and 51 fixed on individual electrodes into the beading glass 6 (refer to FIGS. 23 and 24), and then the first split cylinder portion 4*b*-1 of the small-diameter cylinder electrode 4 is inserted in the small-diameter cylinder portion 5*b* from the front side of the large-diameter cylinder electrode 5 and the end 7*a* of the first split cylinder portion 4*b*-1 is fixed by welding at a welding portion 7 to the end 7*b* of the second split cylinder portion 4*b*-2 fixed already to the beading glass 6**.

Therefore in comparison with an electron gun of a type wherein all electrodes can be fixed at the same time, a problem exists in that positioning work and welding work are added to the work during electron gun assembly and the assembling work is complicated and maintaining of the positional precision between individual electrodes is difficult.

In order to solve the problem, a method may be thought that before fixing the electrode supports 41 to the small-diameter cylinder electrode 4, the small-diameter cylinder portion **4*b* of the small-diameter cylinder electrode 4 is passed through the small-diameter cylinder portion 5*b* of the large-diameter cylinder portion 5*b* of the large-diameter cylinder electrode 5 and then the supports 41 of the small-diameter cylinder electrode 4 are attached to the small-diameter cylinder portion 4*b* of the small-diameter cylinder electrode 4. In this method, however, a process of assembling the large-diameter cylinder electrode 5 and the small-diameter cylinder electrode 4** beforehand is separately required, and also there is difficulty in transporting the half-assembled electrode parts.

In the electron gun of this type wherein a diameter of the large-diameter cylinder portion **4*a* of the small-diameter cylinder electrode 4 is made larger than that of the small-diameter cylinder portion 5*b*** of the large-diameter cylinder electrode 5, the effective lens diameter is large and as a result, a high resolution cathode ray tube can be obtained.

In the electron gun, however, in order to decrease the lens magnification, a length of the small-diameter cylinder electrode 4 serving as the fourth grid must be lengthened in the tube axis direction.

As explained in FIG. 26, a small-diameter cylinder electrode 4 in the prior art is manufactured in such a way that a first split cylinder portion 4*b*-1 and a second split cylinder portion 4*b*-2 are manufactured separately and these are made integral component by welding. In this constitution, precision of parts must be secured in part A being the large-diameter cylinder portion 4*a* of the first split cylinder portion 4*b*-1, part B being a part 4*b*-1 of the small-diameter cylinder portion 4*b* and part C being the second split cylinder portion 4*b*-2, i.e., the remaining part of the small-diameter cylinder portion 4*b* respectively. Therefore a problem exists in that manufacturing work of parts in high precision is required and work in high precision is required also during incorporating the electron gun.

In order to solve this problem, it has been tried to manufacture the whole small-diameter cylinder electrode as an integral part.

FIG. 27 is a side view partly in section showing another configuration example of a small-diameter cylinder electrode 4 wherein the large diameter cylinder portion 4*a* and the small-diameter cylinder portion 4*b* of the small-diameter cylinder electrode 4 are drawn integrally from an electrode material.

In this configuration, however, although the electron gun assembling work is improved, since the part B being the small-diameter cylinder portion 4*b* becomes long, it is difficult to secure the uniform precision along the length of the part B and a problem exists in that the part B is liable to be deformed during transportation.

SUMMARY OF THE INVENTION

In order to solve the above-mentioned problems in the prior art, an object of the present invention is to provide a cathode ray tube having an electron gun using an electron lens comprising a first cylinder (large-diameter cylinder electrode) having an outer diameter restricted by an inner diameter of a neck portion of the cathode ray tube and a second cylinder electrode (small-diameter cylinder electrode) inserted in the first cylinder electrode and having a front end portion of a large diameter so that the first cylinder electrode and the second cylinder electrode constitute an electron lens, particularly to provide a cathode ray tube with an electron gun having an electron lens of a large diameter wherein assembly of the electron gun is easy and the productivity is high and the electrodes are supported and fixed firmly and assembling of high precision becomes possible.

A further object of the present invention is to solve the above-mentioned problems in the prior art in electrode parts long in the tube axis direction, and to provide an electron gun for a cathode ray tube with a small-diameter long cylinder portion wherein manufacturing and assembling work of electrode parts is easy and the productivity is high.

In order to achieve the foregoing objects, the present invention is a cathode ray tube with an electron lens having an electron lens comprising a large-diameter cylinder electrode and a small-diameter cylinder electrode connecting a large-diameter cylinder portion and a small-diameter cylinder portion and formed by inserting at least the large-diameter cylinder portion of the small-diameter cylinder electrode into the large-diameter cylinder electrode, wherein the small-diameter cylinder portion connected to the large-diameter cylinder electrode and extending in the tube axis direction of the large-diameter cylinder electrode is expanded or bulged, or the bottom of the large-diameter cylinder electrode is removed while only electrode support portions connected to the large-diameter cylinder electrode are left, so that the electrode support fixed to the outer surface of the small-diameter cylinder electrode can pass through.

In order to solve the problems in the electrode parts long in the tube axis direction, in the present invention, the small-diameter long electrode is formed as an integrally drawn component and a medium-diameter portion not requiring so high precision is provided between end portions.

In the above-mentioned configuration, since the medium-diameter portion not requiring so high precision is provided, the small-diameter cylinder portion of the small-diameter cylinder electrode is shortened and the precision of the parts can be improved, not being accompanied by the difficulty of the manufacturing work and the assembling work of the electron gun becomes easy.

Further, the small-diameter cylinder electrode is made an integrally drawn component thereby the mechanical strength is improved and deformation during transportation can be prevented.

BRIEF DESCRIPTION OF THE DRAWINGS

In the drawings, which form an integral part of the specification and are to be read in conjunction therewith, and in which like reference numerals designate similar components throughout the figures, and in which:

FIG. 1A is a front view of a large-diameter cylinder electrode viewing from the side of a small-diameter cylinder portion;

FIG. 1B is a side view of the large-diameter cylinder electrode in FIG. 1A viewing from the direction Y—Y;

FIG. 1C is a side view of the large-diameter cylinder electrode in FIG. 1A viewing from the direction X—X;

FIG. 2 is an explanation diagram of state that a small-diameter cylinder portion of a small-diameter cylinder electrode is inserted in a small-diameter cylinder portion of a large-diameter cylinder electrode shown in FIGS. 1A to 1C and passes through;

FIG. 5A is a front view of a large-diameter cylinder electrode viewing from the side of a small-diameter cylinder portion;

FIG. 5B is a side view of the large-diameter cylinder electrode in FIG. 5A viewing from the direction Y—Y;

FIG. 5C is a side view of the large-diameter cylinder electrode in FIG. 5A viewing from the direction X—X;

FIG. 8A is a front view of a large-diameter cylinder electrode viewing from the side of a small-diameter cylinder portion;

FIG. 8B is a side view of the large-diameter cylinder electrode in FIG. 8A viewing from the direction Y—Y;

FIG. 8C is a side view of the large-diameter cylinder electrode in FIG. 8A viewing from the direction X—X;

FIG. 11A is a front view of a large-diameter cylinder electrode viewing from the side of a small-diameter cylinder portion;

FIG. 11B is a side view of the large-diameter cylinder electrode in FIG. 11A viewing from the direction Y—Y;

FIG. 11C is a side view of the large-diameter cylinder electrode in FIG. 11A viewing from the direction X—X;

DETAILED DESCRIPTION OF THE PREFERRED EMBODIMENTS

Embodiments of the present invention will be described further in detail referring to the accompanying drawings as follows.

Figure 1A:
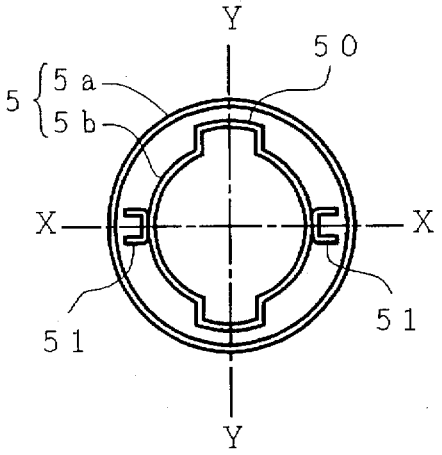
FIGS. 1A to 1C are explanation diagrams of a large-diameter cylinder electrode constituting an electron gun in a first embodiment of a cathode ray tube of the invention.
Figure 1B:
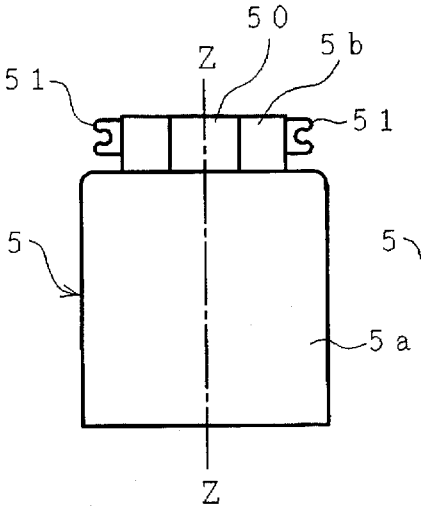
Figure 1C:
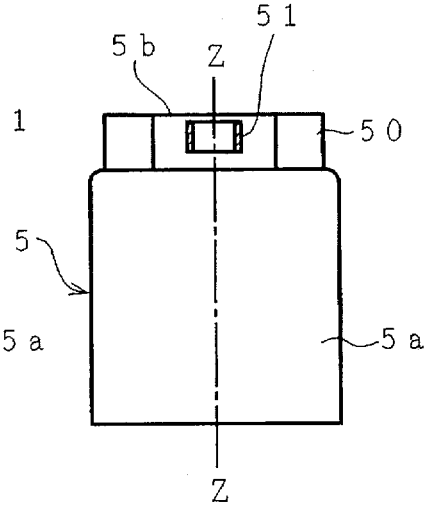

FIGS. 1A to 1C are explanation diagrams of a large-diameter cylinder electrode constituting an electron gun in a first embodiment of a cathode ray tube of the present invention. FIG. 1A is a front view of a large-diameter cylinder electrode viewed from the side of a small-diameter cylinder portion, FIG. 1B is a side view of the large-diameter cylinder electrode in FIG. 1A viewed in the direction Y—Y, and FIG. 1C is a side view of the large-diameter cylinder electrode in FIG. 1A viewed in the direction X—X.

In FIGS. 1A to 1C, numeral 5 designates a large-diameter cylinder electrode, numeral **5*a* designates a large-diameter cylinder portion, numeral 5*b* designates a small-diameter cylinder portion, numeral 50 designates an expanded portion, and numeral 51** designates an electrode support.

The large-diameter cylinder electrode 5 has a large-diameter cylinder portion **5*a*, and a small-diameter cylinder portion 5*b* connected to the large-diameter cylinder portion 5*a* and extending in the tube axis direction Z—Z towards a cathode. The large-diameter cylinder electrode 5 has also a pair of electrode supports 51 fixed on the outer surface of the small-diameter cylinder portion 5*b*** and diametrically opposed in the direction X—X.

The small-diameter cylinder portion **5*b* is provided with an expanded portion 50 formed in the direction rotated by 90 degrees around the tube axis with respect to the electrode support 51**, that is, diametrically opposed in the direction Y—Y and partially bulging and extending in the tube axis direction.

Figure 2:
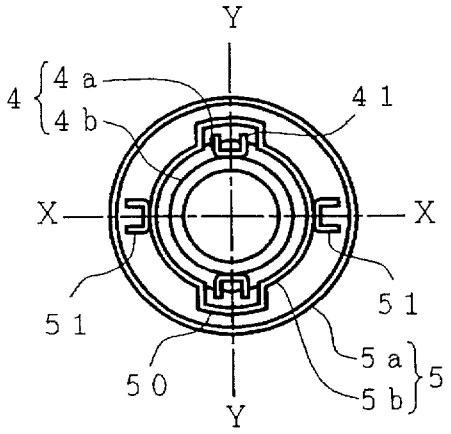

FIG. 2 is an explanation diagram of the state in which a small-diameter cylinder portion of a small-diameter cylinder electrode is inserted in and is passed through the small-diameter cylinder portion **5*b* of the large-diameter cylinder electrode 5 shown in FIGS. 1A to 1C. In FIG. 2, numeral 4 designates a small-diameter cylinder electrode, numeral 4*a* designates a large-diameter cylinder portion of the small-diameter cylinder electrode 4, numeral 4*b* designates a small-diameter cylinder portion of the small-diameter cylinder electrode 4, and numeral 41 designates an electrode support fixed to the small-diameter cylinder portion 4*b* of the small-diameter cylinder electrode 4**. The same reference numeral as that of FIG. 1 corresponds to the same part.

As shown in FIG. 2, when the small-diameter cylinder electrode 4 is assembled to the large-diameter cylinder electrode 5, the small-diameter cylinder electrode 4 is rotated by 90 degrees around the tube axis with respect to the large-diameter cylinder electrode 5 and the small-diameter cylinder portion 4b of the small-diameter cylinder electrode 4 is inserted in the small-diameter cylinder portion 5b of the large-diameter cylinder electrode 5.

The large-diameter cylinder portion 4a of the small-diameter cylinder electrode 4 remains in the large-diameter cylinder portion 5a of the large-diameter cylinder electrode 5, and the electrode supports 41 fixed to the small-diameter cylinder portion 4b of the small-diameter cylinder electrode 4 pass through the expanded portion 50 formed on the small-diameter cylinder portion 5b of the large-diameter cylinder electrode 5.

After the electrode supports 41 fixed to the small-diameter cylinder portion 4b of the small-diameter cylinder electrode 4 pass through the expanded portion 50 formed on the small-diameter cylinder portion 5b of the large-diameter cylinder electrode 5, the small-diameter cylinder electrode 4 is rotated by 90 degrees around the tube axis thereby the electrode supports 41 are aligned with the electrode supports 51 fixed to the small-diameter cylinder portion 5b of the large-diameter cylinder electrode 5. In this state, individual electrode supports 41, 51 are embedded in the beading glass and fixed.

Figure 3:
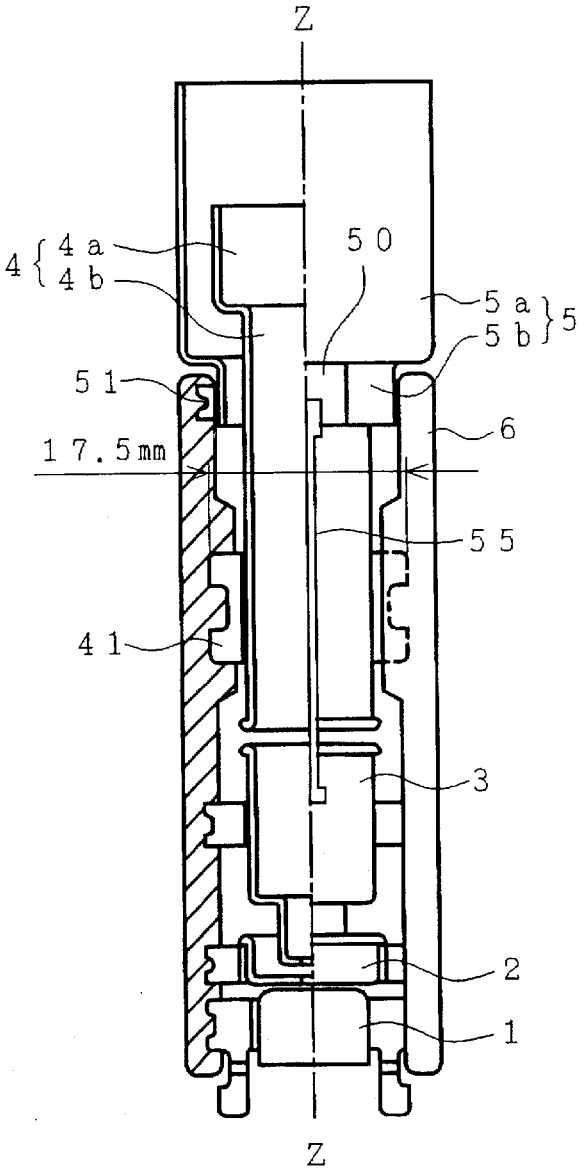
FIG. 3 is a side view with essential portions cutaway explaining an overall configuration of an electron gun in the first embodiment of the invention.
Figure 4:
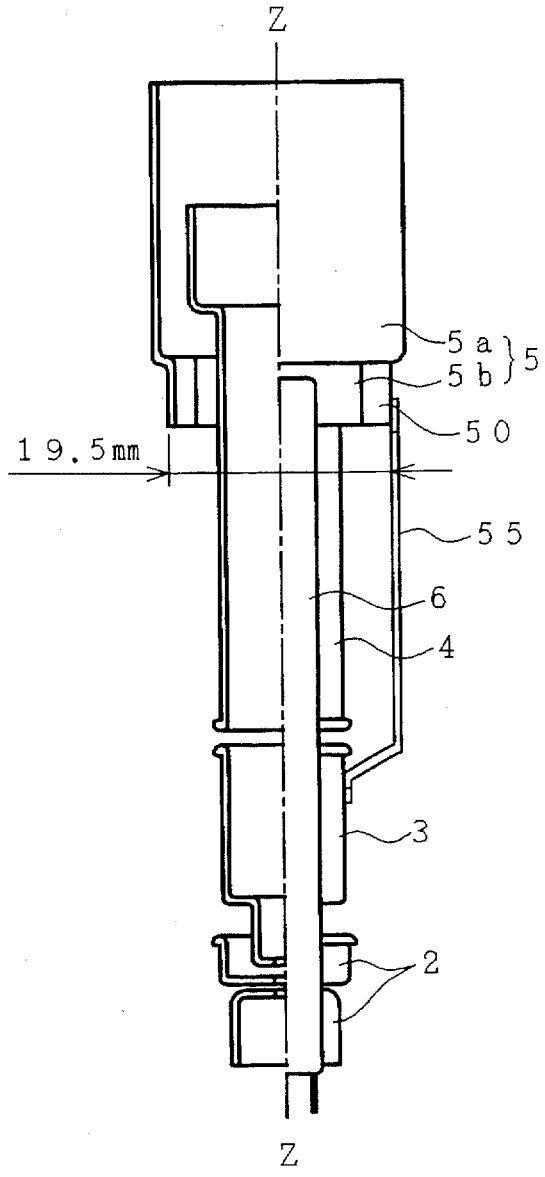
FIG. 4 is a side view with essential portions cutaway showing the electron gun in FIG. 3 rotated by 90 degrees around the tube axis Z—Z.

FIG. 3 is a side view with essential portions cutaway explaining an overall configuration of an electron gun of this embodiment, and FIG. 4 is a side view with essential portions cutaway showing the electron gun in FIG. 3 rotated by 90 degrees around the tube axis Z—Z. In FIGS. 3 and 4, the same reference numeral as that of FIG. 1 corresponds to the same part.

As shown in FIGS. 3 and 4, the large-diameter cylinder portion 4a of the small-diameter cylinder electrode 4 is contained in the large-diameter cylinder portion 5a of the large-diameter cylinder electrode 5, and the small-diameter cylinder portion 4b of the small-diameter cylinder electrode 4 passes through the small-diameter cylinder portion 5b of the large-diameter cylinder electrode 5 and extends towards a cathode.

In the electron gun, the potential difference is given between the large-diameter cylinder electrode 5 and the small-diameter cylinder electrode 4, thereby a main lens is formed in a region of the inner wall of the large-diameter cylinder portion 5a of the large-diameter cylinder electrode 5 and the open end of the large-diameter cylinder portion 4a of the small-diameter cylinder electrode 4, and an electron beam from the first, second and third grids 1, 2, 3 is accelerated and focused and projected onto a screen.

Dimensions shown in FIGS. 3 and 4 respectively are a distance between ends of the electrode supports 41 of the small-diameter cylinder portion 4b of the small-diameter cylinder electrode 4 and a dimension example of the expanded portion of the large-diameter cylinder electrode 5, and a difference between them is about 2 mm. In addition, this dimension is, of course, only an example. Reference numeral 55 designates a lead wire connecting electrically the large-diameter cylinder electrode 5 and the third grid 3.

According to the first embodiment of the present invention constituted as described above, a cathode ray tube with an electron gun having a large-diameter electron lens can be provided wherein the assembly of the electron gun is easy and productivity is high and the electrodes are supported and fixed firmly and the assembly of high precision becomes possible.

Figure 5A:
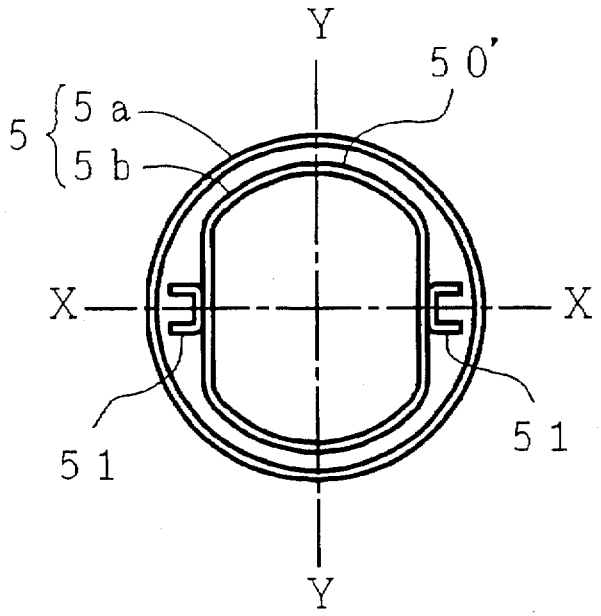
FIGS. 5A to 5C are explanation diagrams of a large-diameter cylinder electrode constituting an electron gun in a second embodiment of the invention.
Figure 5B:
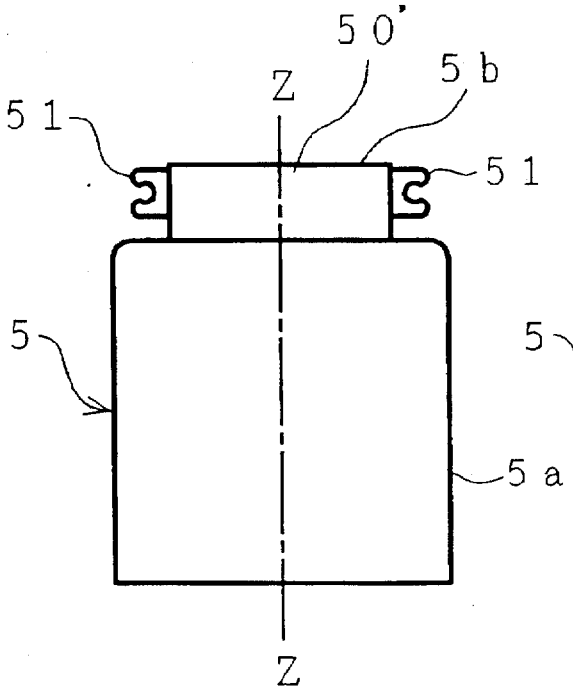
Figure 5C:
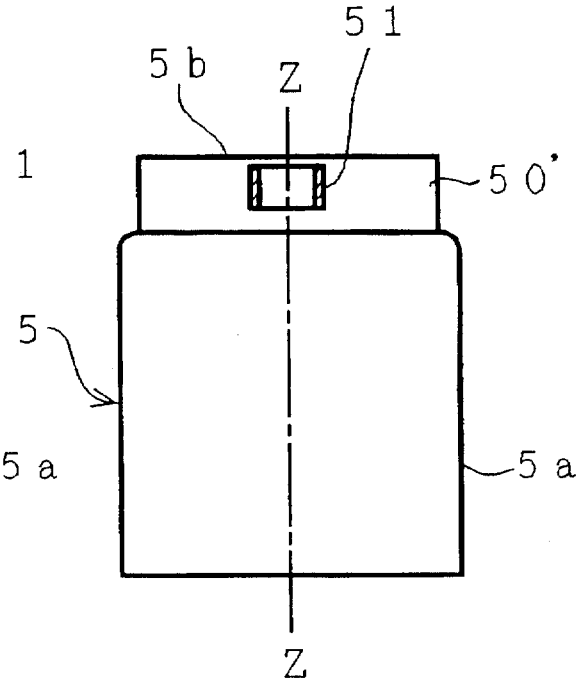

FIGS. 5A to 5C are explanation diagrams of a large-diameter cylinder electrode constituting an electron gun in a second embodiment of a cathode ray tube of the present invention. FIG. 5A is a front view of a large-diameter cylinder electrode viewed from the side of a small-diameter cylinder portion, FIG. 5B is a side view of the large-diameter cylinder electrode in FIG. 5A viewed in the direction Y—Y, and FIG. 5C is a side view of the large-diameter cylinder electrode in FIG. 5A viewed in the direction X—X.

In FIGS. 5A to 5C, numeral 5 designates a large-diameter cylinder electrode, numeral 5a designates a large-diameter cylinder portion, numeral 5b designates a small-diameter cylinder portion, and numeral 50' designates a bulged portion with a cross-section constituting an oval or oblong shape having a major axis in the direction displaced by about 90 degrees around the tube axis with respect to electrode supports 51 in a plane orthogonal to the tube axis.

The large-diameter cylinder electrode 5 has a large-diameter cylinder portion 5a and a small-diameter cylinder portion 5b connected to the large-diameter cylinder portion 5a and extending in the tube axis direction Z—Z towards a cathode. The large-diameter cylinder electrode 5 has also a pair of electrode supports 51 fixed on the outer surface of the small-diameter cylinder portion 5b and diametrically opposed in the direction X—X.

The small-diameter cylinder portion 5b is formed in an oval or oblong shape having major axis in the direction rotated by 90 degrees around the tube axis with respect to the electrode supports 51, that is, diametrically opposed in the direction Y—Y, and the bulged portion 50' is formed so that the electrode supports 41 fixed on the small-diameter cylinder portion 4b of the small-diameter cylinder electrode 4 can pass through it.

Consequently the dividing of the small-diameter cylinder portion 4b of the small-diameter cylinder electrode 4 as described in the prior art is not necessary in this embodiment. When the small-diameter cylinder portion 4b of the small-diameter cylinder electrode 4 is assembled to the large-diameter cylinder electrode 5, the small-diameter cylinder electrode 4 is inserted in the rotated state by about 90 degrees around the tube axis from the position to be fixed to the beading glass thereby the electrode supports 41 fixed on the outer surface of the small-diameter cylinder portion 4b of the small-diameter cylinder electrode 4 pass through the bulged portion 50' of oval shape and then the electrode supports 41 are rotated by 90 degrees around the tube axis and embedded in the beading glass.

Figure 6:
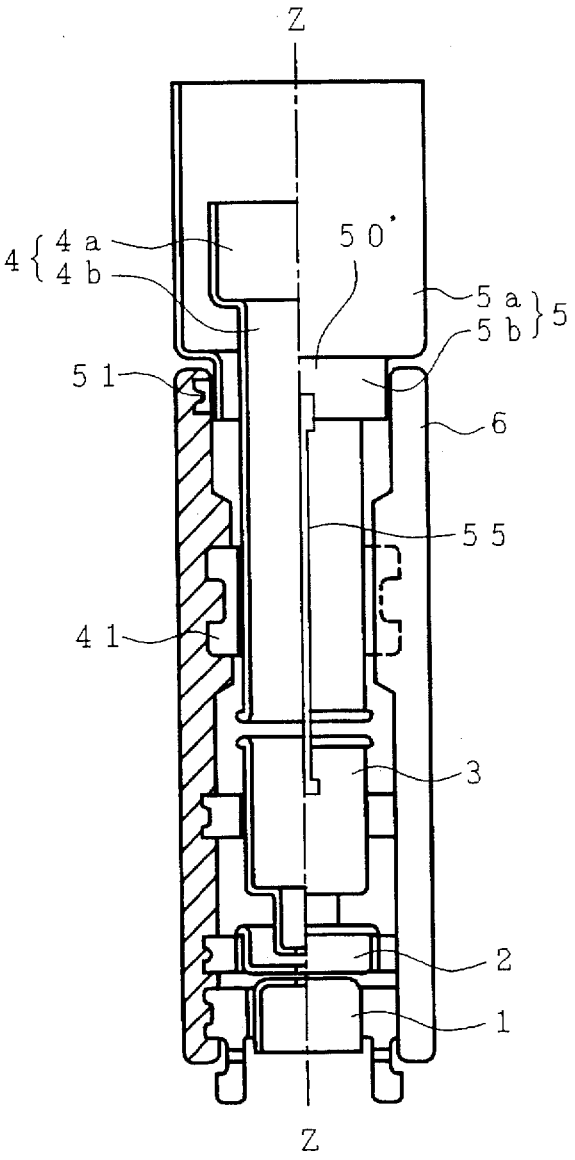
FIG. 6 is a side view with essential portions cutaway explaining an overall configuration of an electron gun in the second embodiment of a cathode ray tube of the invention.
Figure 7:
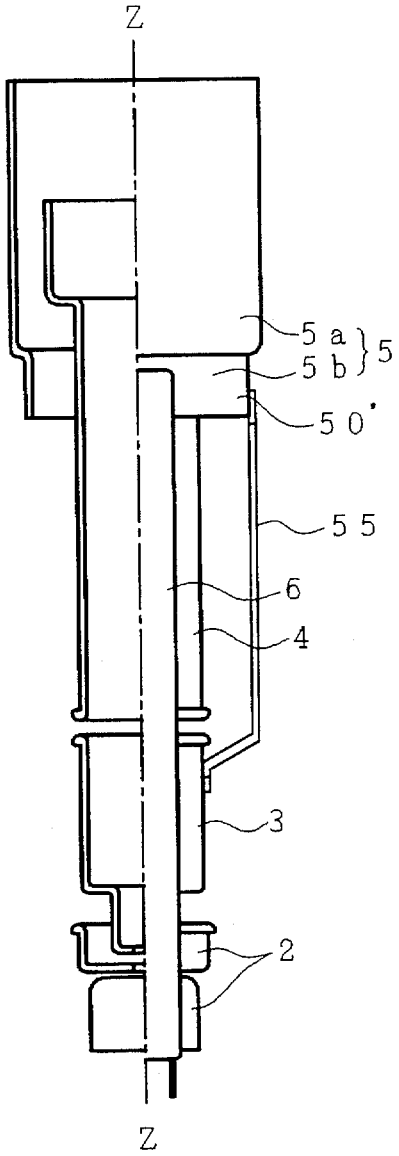
FIG. 7 is a side view with essential portions cutaway showing the electron gun in FIG. 6 rotated by 90 degrees around the tube axis Z—Z.

FIG. 6 is a side view with essential portions cutaway explaining an overall configuration of an electron gun of this embodiment, and FIG. 7 is a side view with essential portions cutaway showing the electron gun in FIG. 6 rotated by 90 degrees around the tube axis Z—Z. In FIGS. 6 and 7, the same reference numeral as that of FIG. 5 corresponds to the same part.

The large-diameter cylinder portion 4a of the small-diameter cylinder electrode 4 is contained in the large-diameter cylinder portion 5a of the large-diameter cylinder electrode 5, and the small-diameter cylinder portion 4b of the small-diameter cylinder electrode 4 passes through the small-diameter cylinder portion 5b of the large-diameter cylinder electrode 5 and extends towards a cathode. Reference numeral 55 designates a lead wire connecting electrically the large-diameter cylinder electrode 5 and the third grid 3.

In the electron gun, the potential difference is given between the large-diameter cylinder electrode 5 and the small-diameter cylinder electrode 4, thereby a main lens is formed in a region of the inner wall of the large-diameter cylinder portion 5a of the large-diameter cylinder electrode 5 and the open end of the large-diameter cylinder portion 4a of the small-diameter cylinder electrode 4, and an electron beam from the first, second and third grids 1, 2, 3 is accelerated and focused and projected onto a screen.

According to the second embodiment of the present invention constituted as described above, a cathode ray tube with an electron gun having a large-diameter electron lens can be provided wherein the assembly of the electron gun is easy and productivity is high and the electrodes are supported and fixed firmly and assembly of high precision becomes possible.

Figure 8A:
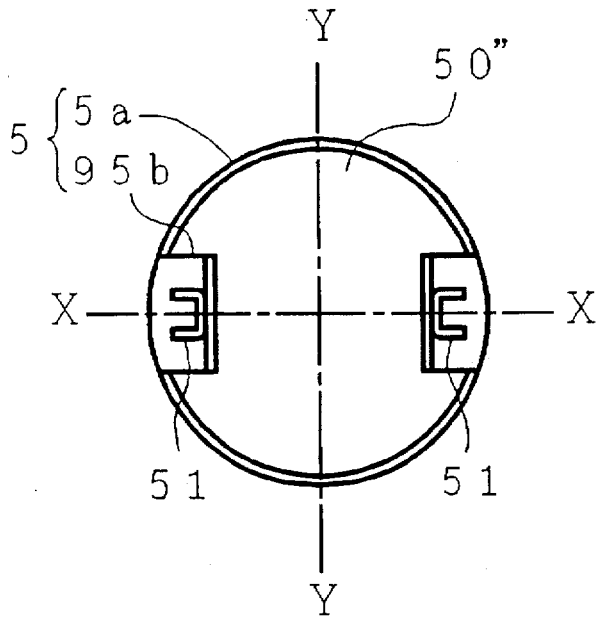
FIGS. 8A to 8C are explanation diagrams of a large-diameter cylinder electrode constituting an electron gun in a third embodiment of a cathode ray tube of the invention.
Figure 8B:
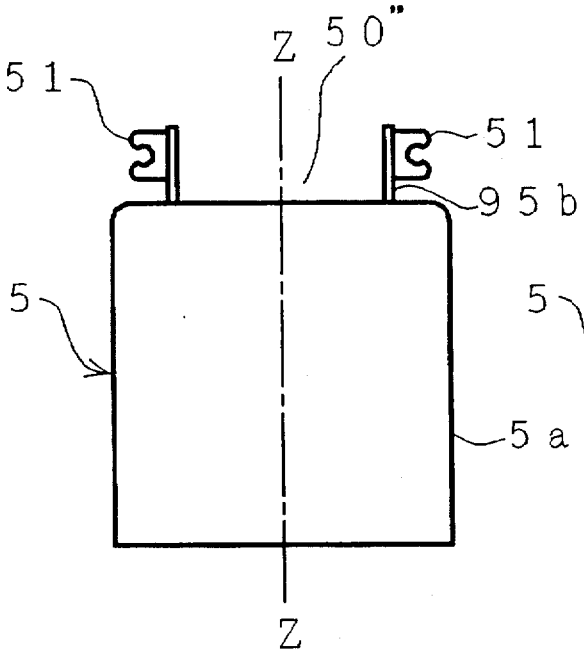
Figure 8C:
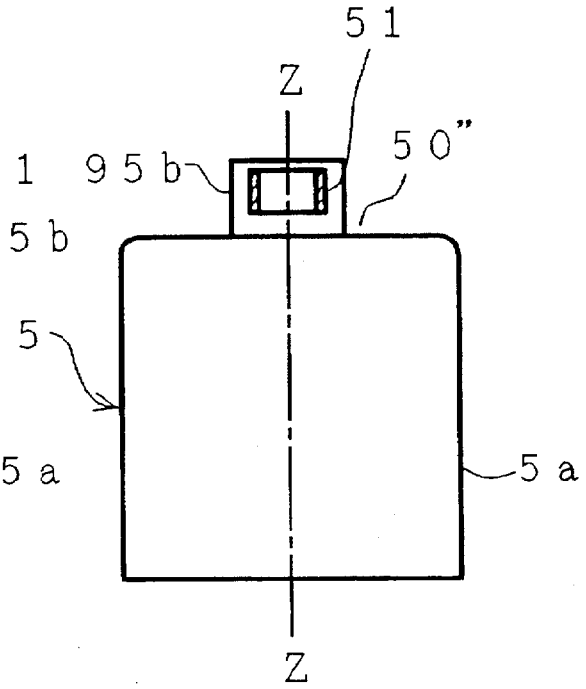

FIGS. 8A to 8C are explanation diagrams of a large-diameter cylinder electrode constituting an electron gun in a third embodiment of a cathode ray tube of the present invention. FIG. 8A is a front view of a large-diameter cylinder electrode viewed from the side of a small-diameter cylinder portion, FIG. 8B is a side view of the large-diameter cylinder electrode in FIG. 8A viewed in the direction Y—Y, and FIG. 8C is a side view of the large-diameter cylinder electrode in FIG. 8A viewed in the direction X—X.

In FIGS. 8A to 8C, numeral 5 designates a large-diameter cylinder electrode, numeral 5a designates a large-diameter cylinder portion, numeral 95b designates a pair of electrode support portions connected to the large-diameter cylinder portion 5a and extending in the tube axis direction, and numeral 50" designates an opening formed at the bottom portion of the large-diameter cylinder electrode 5.

The opening 50" is formed in that the bottom portion of the large-diameter cylinder portion 5a of the large-diameter cylinder electrode 5 is removed while the pair of electrode support portions 95b is left. The opening 50" is formed so that the supports 41 of the small-diameter cylinder electrode 4 is allowed to pass in the tube axis direction at the position displaced in the direction orthogonal to the direction of the electrode support portions 95b of the large-diameter cylinder electrode 5 around the tube axis.

When the small-diameter cylinder portion 4b of the small-diameter cylinder electrode 4 is inserted in the large-diameter cylinder electrode 5 and assembled, the small-diameter cylinder electrode 4 is inserted in the rotated state by about 90 degrees around the tube axis from the position to be fixed to the beading glass and the electrode support 41 fixed on the small-diameter cylinder portion 4b of the small-diameter cylinder electrode 4 passes through the opening 50", and then the electrode support 41 is rotated by 90 degrees around the tube axis and embedded in the beading glass.

The large-diameter cylinder electrode 5 has a large-diameter cylinder portion 5a and an electrode support portion 95b connected to the large-diameter cylinder portion 5a and extending in the tube axis direction Z—Z towards a cathode, and has a pair of electrode supports 51 fixed on the outer surface of the electrode support portion 95b and diametrically opposed in the direction X—X.

Consequently the dividing of the small-diameter cylinder portion 4b of the small-diameter cylinder electrode 4 as described in the prior art is not necessary in this embodiment.

Figure 9:
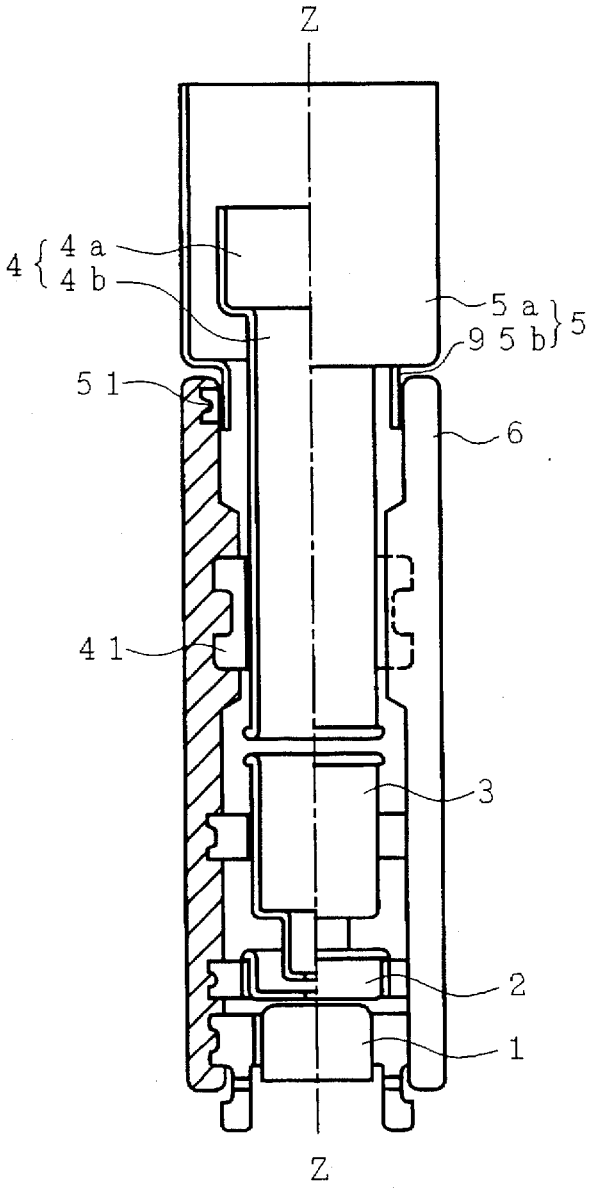
FIG. 9 is a side view with essential portions cutaway explaining an overall configuration of an electron gun in the third embodiment of a cathode ray tube of the invention.
Figure 10:
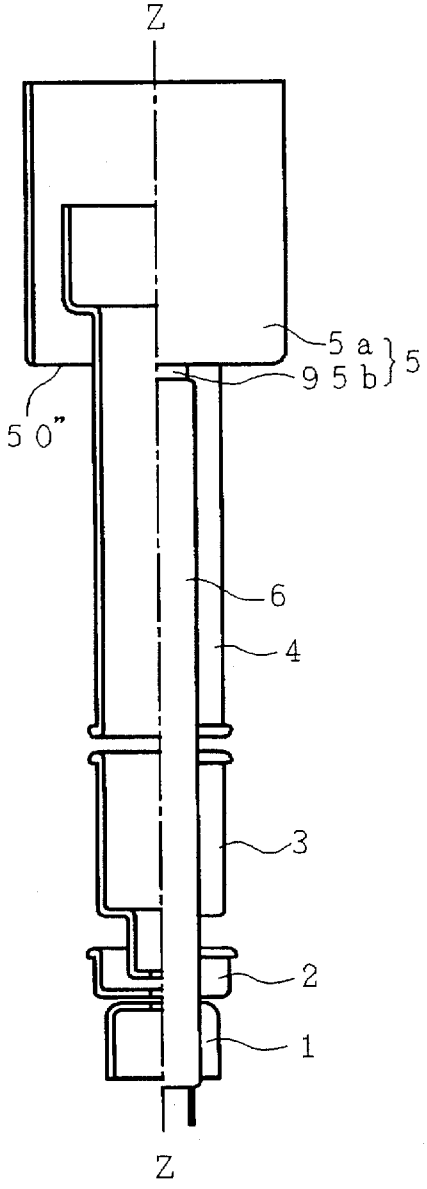
FIG. 10 is a side view with essential portions cutaway showing the electron gun in FIG. 9 rotated by 90 degrees around the tube axis Z—Z.

FIG. 9 is a side view with essential portions cutaway explaining an overall configuration of an electron gun of this embodiment, and FIG. 10 is a side view with essential portions cutaway showing the electron gun in FIG. 9 rotated by 90 degrees around the tube axis Z—Z. In FIGS. 9 and 10, the same reference numeral as that of FIG. 8 corresponds to the same part.

As shown in FIGS. 9 and 10, the large-diameter cylinder portion 4a of the small-diameter cylinder electrode 4 is contained in the large-diameter cylinder portion 5a of the large-diameter cylinder electrode 5, and the small-diameter cylinder portion 4b of the small-diameter cylinder electrode 4 passes through the small-diameter cylinder portion 5b of the large-diameter cylinder electrode 5 and extends towards a cathode.

Also in the electron gun, the potential difference is given between the large-diameter cylinder electrode 5 and the small-diameter cylinder electrode 4 thereby a main lens is formed in a region of the inner wall of the large-diameter cylinder portion 5a of the large-diameter cylinder electrode 5 and the open end of the large-diameter cylinder portion 4a of the small-diameter cylinder electrode 4, and an electron beam from the first, second and third grids 1, 2, 3 is accelerated and focused and projected onto a screen.

According to the third embodiment of the present invention constituted as described above, a cathode ray tube with an electron gun having a large-diameter electron lens can be provided wherein the assembly of the electron gun is easy and productivity is high and the electrodes are supported and fixed firmly and the assembly of high precision becomes possible.

Figure 11A:
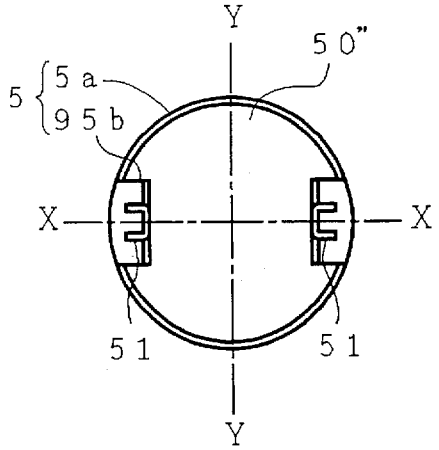
FIGS. 11A to 11C are explanation diagrams of a large-diameter cylinder electrode constituting an electron gun in a fourth embodiment of a cathode ray tube of the invention.
Figure 11B:
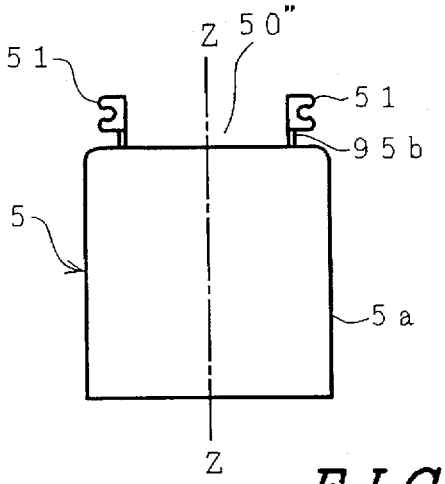
Figure 11C:
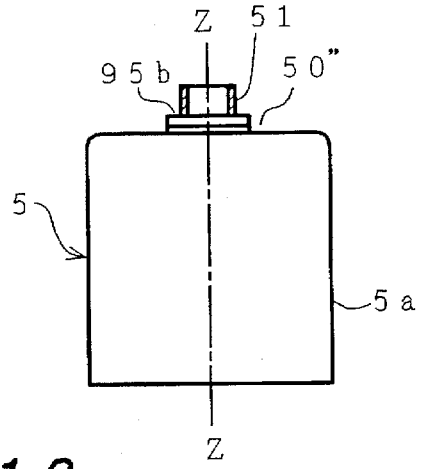

FIGS. 11A to 11C are explanation diagrams of a large-diameter cylinder electrode constituting an electron gun in a fourth embodiment of a cathode ray tube of the present invention. FIG. 11A is a front view of a large-diameter cylinder electrode viewed from the side of a small-diameter cylinder portion, FIG. 11B is a side view of the large-diameter cylinder electrode in FIG. 11A viewed in the direction Y—Y, and FIG. 11C is a side view of the large-diameter cylinder electrode in FIG. 11A viewed in the direction X—X.

In FIGS. 11A to 11C, in similar manner to FIGS. 8A to 8C, numeral 5 designates a large-diameter cylinder electrode, numeral 5a designates a large-diameter cylinder portion, numeral 95b designates a pair of electrode support portions connected to the large-diameter cylinder portion 5a and extending in the tube axis direction, and numeral 50" designates an opening formed at the bottom portion of the large-diameter cylinder electrode 5.

The opening 50" is formed such that the bottom portion of the large-diameter cylinder portion 5a of the large-diameter cylinder electrode 5 is removed while the pair of electrode support portions 95b is left. The opening 50" is formed so that supports of the small-diameter cylinder electrode is allowed to pass in the tube axis direction at the position displaced in the direction orthogonal to the electrode support portions 95b of the large-diameter cylinder electrode 5 around the tube axis Z—Z.

In this embodiment, the electrode supports 51 of the electrode support portion 95b connected to the large-diameter cylinder electrode 5 in the third embodiment as described above is drawn integrally from the electrode support portion 95b, and the electrode support portions 95b itself may be drawn integrally from the bottom surface of the large-diameter cylinder electrode 5. Since other configuration is similar to the third embodiment, the description shall be omitted.

In addition, also the electrode support 51 of the large-diameter cylinder electrode 5 in the first and second embodiments may be drawn integrally from the small-diameter cylinder electrode 5b.

Figure 12:
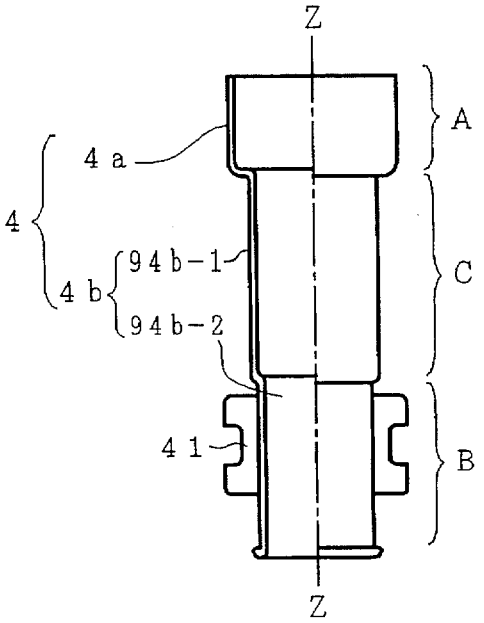
FIG. 12 is a side view with essential portions cutaway explaining an embodiment of a small-diameter cylinder electrode constituting an electron gun for a cathode ray tube of the invention.

FIG. 12 is a side view partly in section explaining an embodiment of a small-diameter cylinder electrode constituting an electron gun for a cathode ray tube according to the present invention. In FIG. 12, numeral 4 designates a small-diameter cylinder electrode, numeral 4*a* designates a large-diameter cylinder portion, numeral 4*b* designates a small-diameter cylinder portion, numeral 94*b*-1 designates a medium-diameter portion, numeral 94*b*-2 designates an end portion, and numeral 41 designates an electrode support.

In FIG. 12, the large-diameter cylinder portion 4*a*, and the medium-diameter cylinder portion 94*b*-1 and the end portion 94*b*-2 constituting the small-diameter cylinder portion 4*b* are manufactured as a unitary electrode component by drawing process.

In the small-diameter cylinder electrode 4, although high precision is required in A part, i.e., the large-diameter cylinder portion 4*a* inserted in the large-diameter cylinder electrode 5 and forming a main lens, and in B part, i.e., the end portion 94*b*-2 facing another cathode-side electrode, since C part, i.e., the medium-diameter portion 94*b*-1 serves as that connecting the large-diameter cylinder portion 4*a* and the end portion 94*b*-2, such high precision is not required there.

The medium-diameter portion 94*b*-1 is lengthened and the end portion 94*b*-2 is shortened, thereby manufacturing of the small-diameter cylinder electrode 4 with high precision becomes easy.

Since a diameter of the large-diameter cylinder portion 4*a* of the small-diameter cylinder electrode 4 is larger than that of the small-diameter cylinder portion 5*b* of the large-diameter cylinder electrode 5, when both are to be assembled, in similar manner to the case of FIG. 2, the end portion 94*b*-2 is inserted in the large-diameter cylinder portion 5*a* of the large-diameter cylinder electrode 5 and the electrode support 41 of the small-diameter cylinder electrode 4 is inserted through an expanded portion 50 of the large-diameter cylinder electrode 5.

And then the small-diameter cylinder electrode 4 is rotated by 90 degrees around the tube axis with respect to the large-diameter cylinder electrode 5 and is embedded in the beading glass and fixed.

Figure 13:
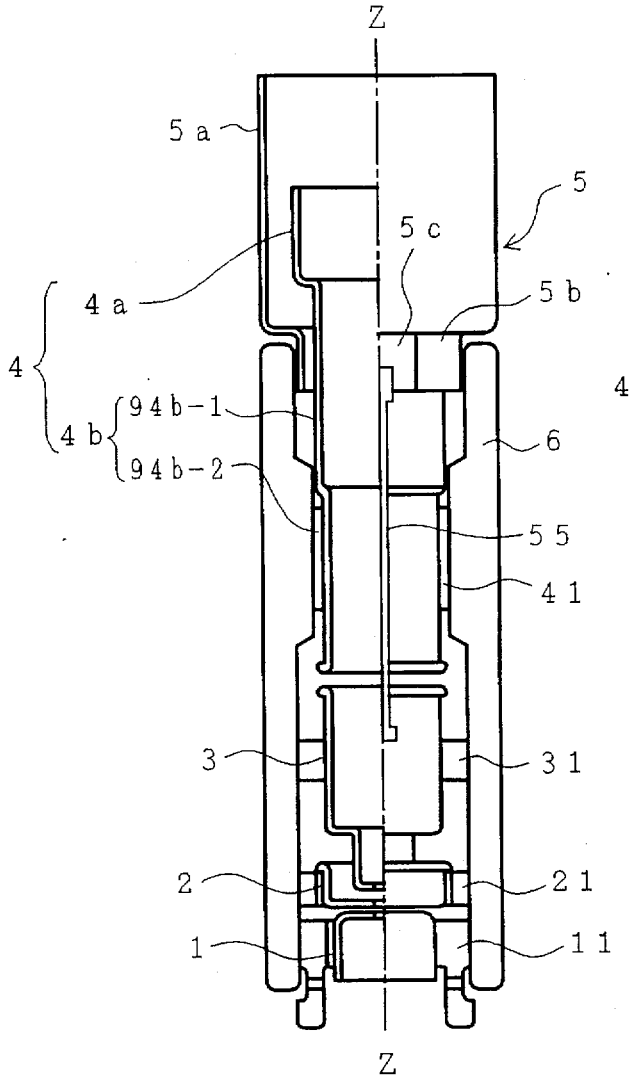
FIG. 13 is a side view with essential portions cutaway explaining an overall configuration of an electron gun for a cathode ray tube of the invention using the small-diameter cylinder electrode in FIG. 12.
Figure 14:
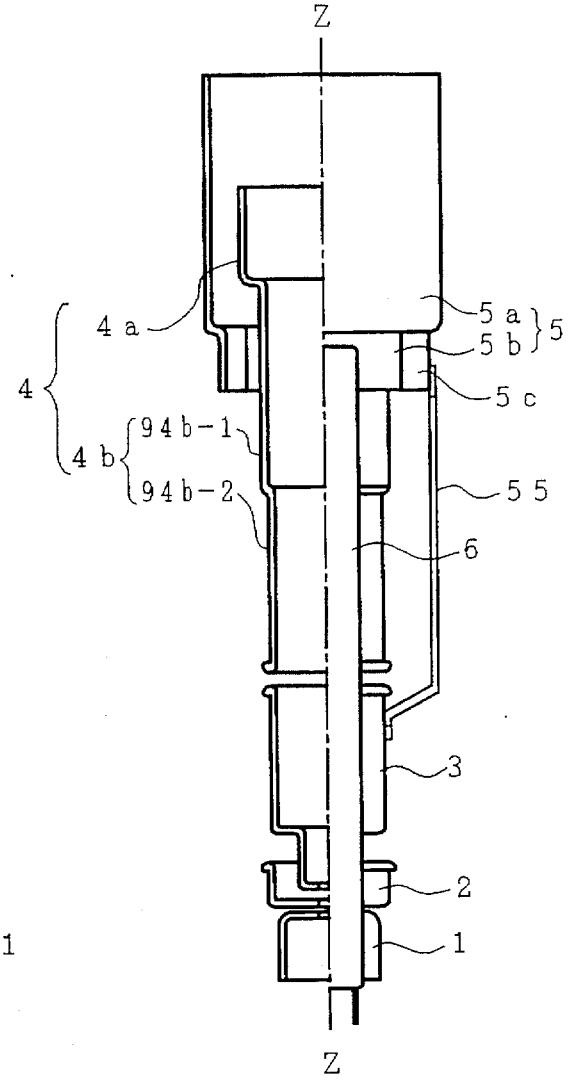
FIG. 14 is a side view of the electron gun in FIG. 13 rotated by 90 degrees around the tube axis Z—Z.

FIG. 13 is a side view partly in section explaining an overall configuration of an electron gun for a cathode ray tube according to the invention, and FIG. 14 is a side view of the electron gun in FIG. 13 rotated by 90 degrees around the tube axis Z—Z.

As shown in FIGS. 13 and 14, in the electron gun, the first grid 1, the second grid 2, the third grid 3, the fourth grid (small-diameter cylinder electrode) 4 and the fifth grid (large-diameter cylinder electrode) 5 are formed as a unit in that individual electrode supports 11, 21, 31, 41, 51 are embedded in the beading glass 6 and fixed and formed as a unit.

According to this embodiment as described above, difficulty in manufacturing the parts can be eliminated and a high-precision cathode ray tube can be obtained, in comparison with that using a small-diameter cylinder electrode by welding the parts divided in two or a conventional small-diameter cylinder electrode not having a medium-diameter portion.

FIGS. 15A to 15E are schematic explanation diagrams showing an example of manufacturing process by drawing process of a small-diameter cylinder electrode 4 constituting an electron gun for a cathode ray tube according to the present invention.

Figure 15A:
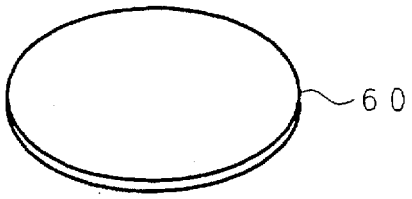
FIGS. 15A to 15E are schematic explanation diagrams of an example of manufacturing process of a small-diameter cylinder electrode constituting an electron gun for a cathode ray tube of the invention.
Figure 15B:
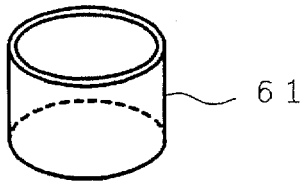
Figure 15C:
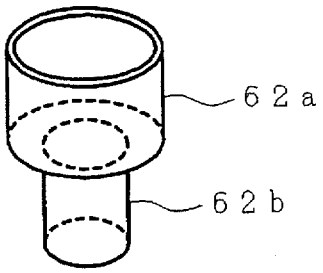

First, a disk-like raw material 60 before drawing is punched from a long stainless steel plate (FIG. 15A), and drawing process is applied to the raw material 60 and a cup-like member 61 is prepared (FIG. 15B).

Figure 15D:
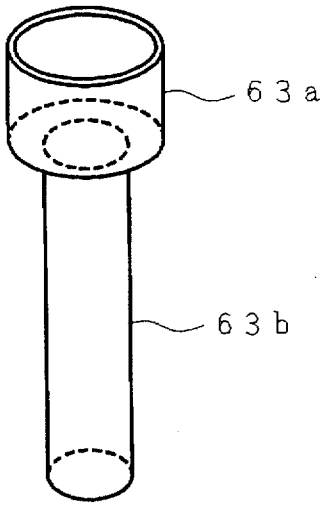

Further, a large-diameter cylinder portion 62*a* is prepared by precision drawing process, and then a small-diameter cylinder portion 62*b* is prepared (FIG. 15C), and a medium-diameter portion 63*b* is obtained by drawing process (FIG. 15D).

Figure 15E:
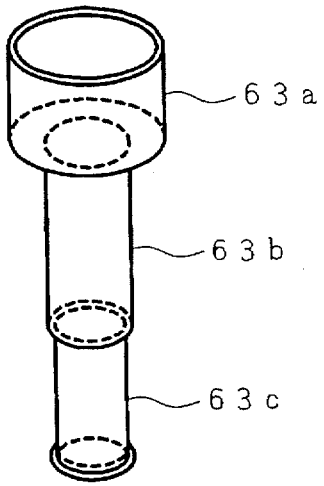

Finally, the medium-diameter portion 63*b* is subjected to precision drawing process and an end portion 63*c* having an open end at the front end is formed (FIG. 15E).

By this process, a small-diameter cylinder electrode being an integrally drawn component having the high-precision large-diameter cylinder portion 62*a* and the end portion 63*c* can be obtained.

Next, a configuration example of a cathode ray tube using the above-mentioned electron gun will be described.

Figure 16:
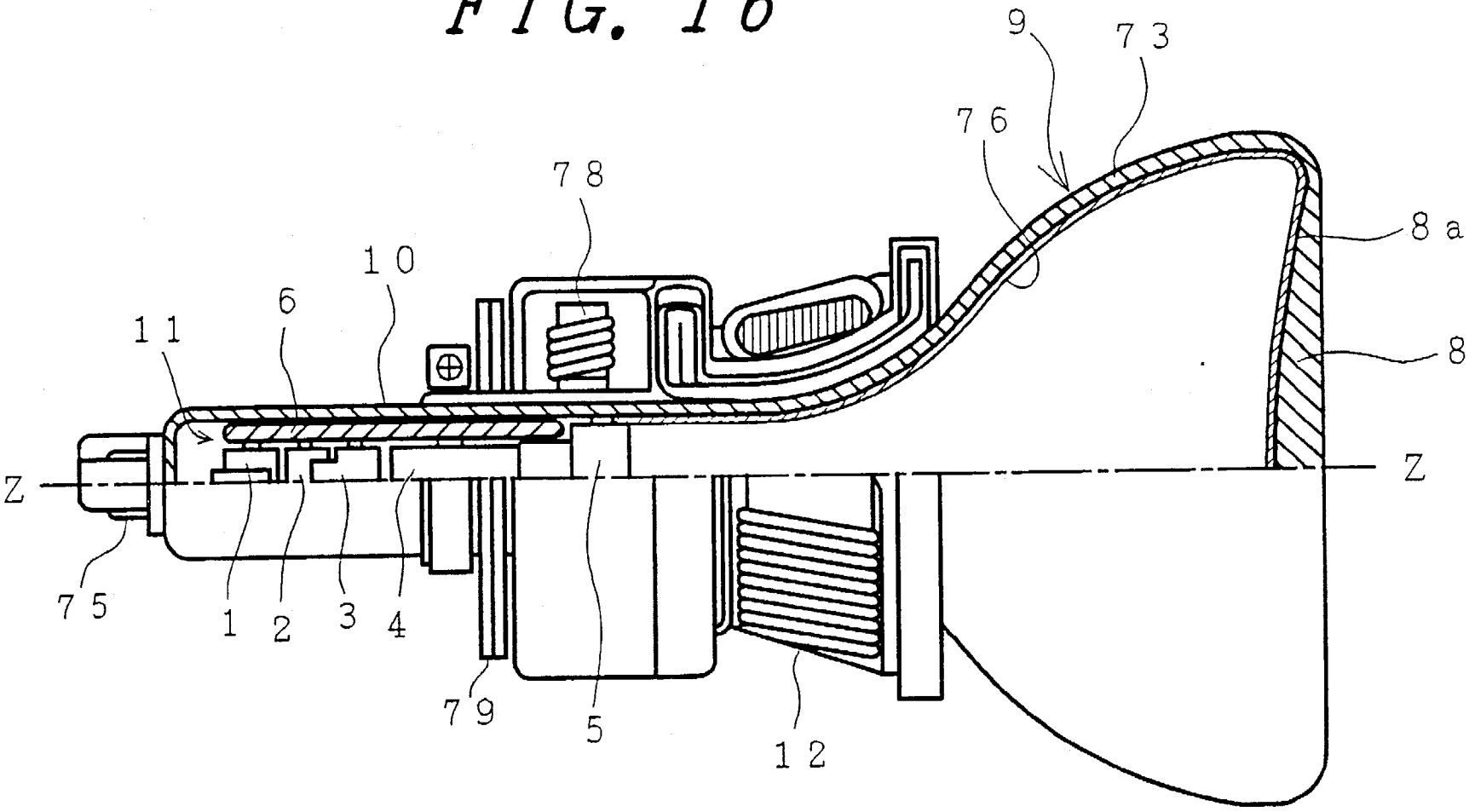
FIG. 16 is a fragmentary sectional view of a projection type cathode ray tube explaining a configuration example of a cathode ray tube of the invention.

FIG. 16 is a fragmentary sectional view of a projection type cathode ray tube explaining a configuration example of a cathode ray tube according to the present invention.

In FIG. 16, numeral 8 designates a panel portion, numeral 8*a* designates a phosphor screen, numeral 10 designates a neck portion, numeral 73 designates a funnel portion, numeral 9 designates an evacuated envelope, numeral 11 designates an electron gun, numeral 75 designates a stem, numeral 76 designates an internal conductive coating, numeral 12 designates a deflection device, numeral 78 designates a convergence coil, and numeral 79 designates a beam centering adjustment magnet.

In FIG. 16, the phosphor screen 8*a* is formed on the inner surface of the panel portion 8 and the electron gun 11 is installed in the neck portion 10. The electron gun 11 is supplied with anode voltage from the internal conductive coating 76, and necessary voltages and a video signal are supplied from pins brought through the stem 75.

An electron beam emitted from the electron gun 11 scans the phosphor screen 8*a* by a magnetic field produced by the deflection device 12 and reproduces the image.

This cathode ray tube is a projection type cathode ray tube, and an electron beam focused at high precision by the large-diameter electron gun 11 forms an image on the phosphor screen 8*a*, and the image is enlarged and projected onto the screen by a projection optical system (not shown).

Since an electron beam in such a cathode ray tube has high current density, the phosphor screen 8*a* is heated to a high temperature and the temperature of the cathode ray tube rises. If the temperature rise becomes too high, stable image forming can not be performed. Consequently the temperature rise must be suppressed.

Figure 17:
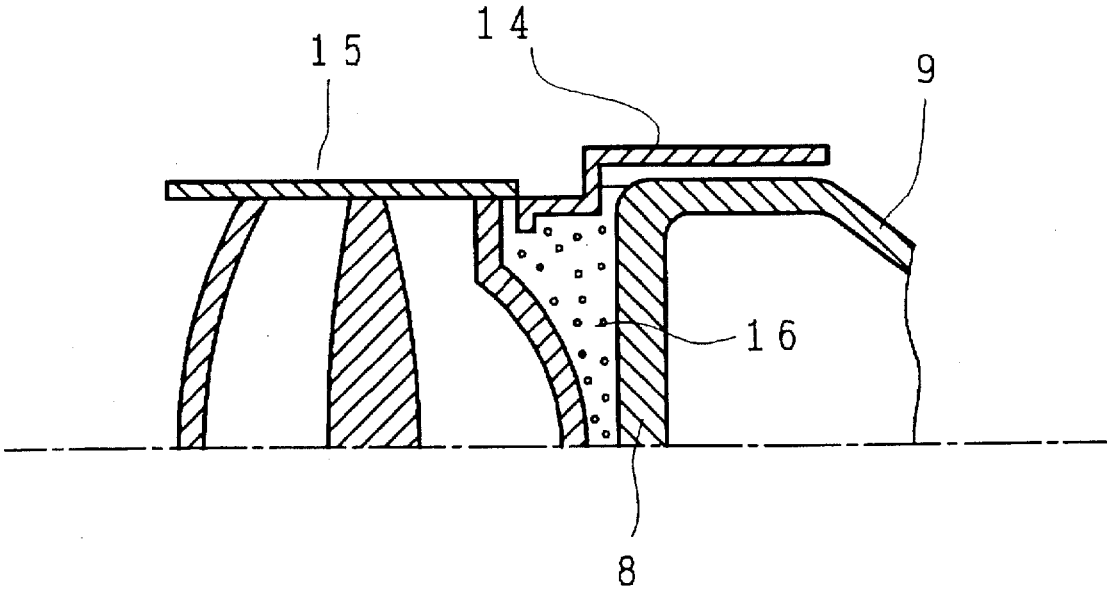
FIG. 17 is a sectional view of essential portions explaining an example of cooling structure of a projection type cathode ray tube.

FIG. 17 is a sectional view of essential portions explaining an example of cooling structure of a projection type cathode ray tube. In FIG. 17, numeral 8 designates a panel portion, numeral 9 designates an evacuated envelope, numeral 15 designates a projection lens, and numeral 16 designates a cooling liquid.

The projection lens 15 is installed on the outer surface of the panel portion 8 of the cathode ray tube through the coupler 14, and a cooling liquid is filled between the coupler 14 and the panel portion 8. The coupler 14 has heat-radiating effect, and heat from the panel portion 8 is radiated to the atmosphere thereby temperature rise of the panel portion 8 is suppressed and the overheating of the cathode ray tube is suppressed and the stable image forming is performed.

Figure 18:
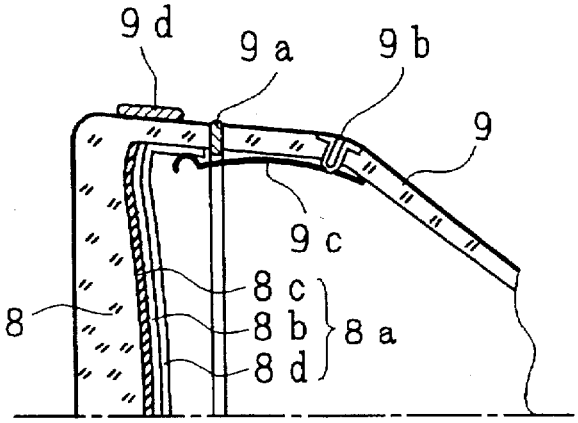
FIG. 18 is a sectional view of essential portions explaining a configuration example of a panel portion of a projection type cathode ray tube.

FIG. 18 is a sectional view of essential portions explaining a configuration example of a panel portion of a projection type cathode ray tube. In FIG. 18, numeral 8*a* designates a phosphor screen, numeral 8b designates a phosphor, numeral 8c designates a multi-layer interference film, numeral 8d designates a metal back, numeral 9 designates an evacuated envelope, numeral 9a designates a frit joining the panel portion 8, numeral 9b designates an anode button for applying high voltage to the phosphor screen, numeral 9c designates a contact spring for connecting the anode button 9b and the metal back 8d, and numeral 9d designates a tension band.

On the phosphor screen 8a are formed the multi-layer interference film 8c, the phosphor 8b and the metal back 8d in the order from the glass inner surface of the panel portion 8d, and high voltage, i.e., the anode voltage is applied to the phosphor screen by the contact spring 9c with one end connected to the anode button 9b and the other end contacted to the metal back 8d.

Figure 19:
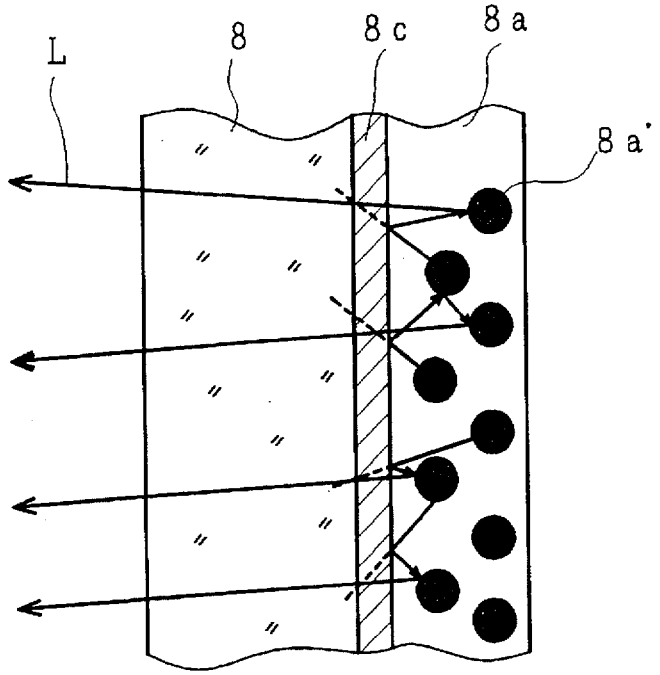
FIG. 19 is a schematic diagram explaining a path of outgoing ray in the vicinity of a multi-layer interference film constituting phosphor screen of a projection type cathode ray tube.

FIG. 19 is a schematic diagram explaining paths of outgoing rays in the vicinity of a multi-layer interference film 8c constituting a phosphor screen of a projection type cathode ray tube. In FIG. 19, numeral 8a' designates phosphor particles constituting a phosphor 8b. In FIG. 19, the same reference numeral as that of FIG. 18 corresponds to the same part.

Figure 20:
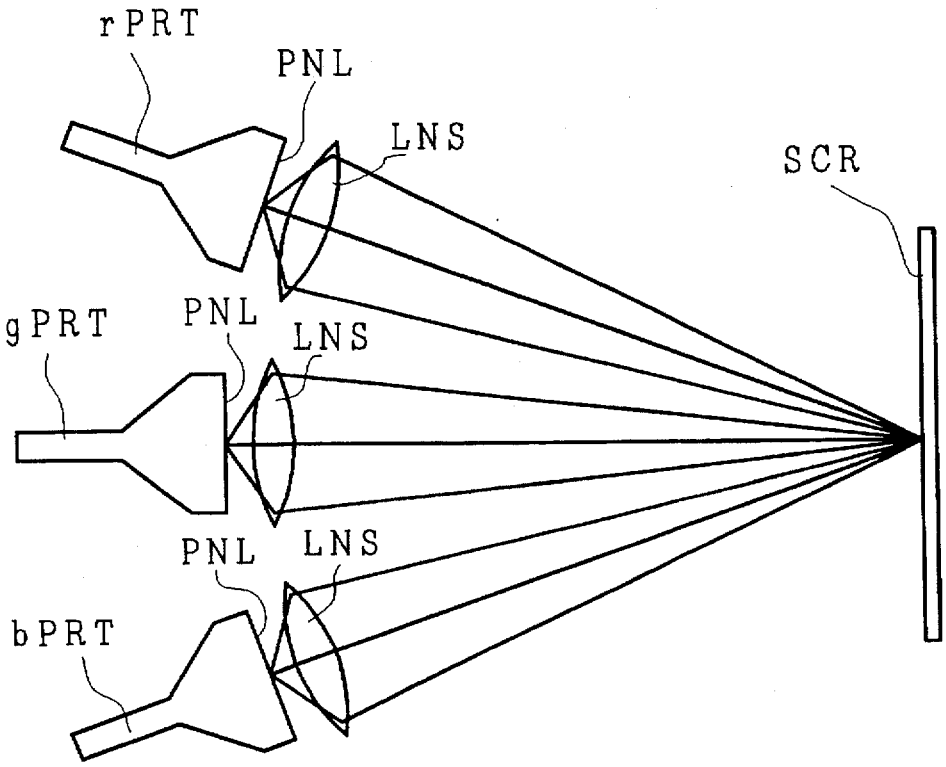
FIG. 20 is a schematic diagram explaining an example of image reproduction system of a color image reproduction apparatus using a projection type cathode ray tube.

FIG. 20 is a schematic diagram explaining an example of image reproduction of a color image reproduction apparatus using a projection type cathode ray tube. In FIG. 20, rPRT, gPRT, bPRT designate projection type cathode ray tubes of red, green and blue respectively, PNL designates a panel being an image-forming section of a projection type cathode ray tube, LNS designates a projection lens (corresponding to lens 15 in FIG. 17), and SCR designates a projection screen.

In FIG. 20, on the center axis of the cathode ray tube gPRT for green, the projection screen SCR is opposed to the panel PNL thereof and disposed at a position spaced a predetermined distance.

On the front surface of each panel of the projection type cathode ray tubes rPRT, gPRT, bPRT, the projection lens LNS is arranged on the axis of each cathode ray tube, and an image of a given single color formed on each panel is enlarged and projected on the screen SCR and superposed on each other, and thereby a color image is formed.

Thus an image reproduction apparatus using a projection type cathode ray tube can realize a large screen easily in comparison with a direct-view TV receiver.

Figure 21:
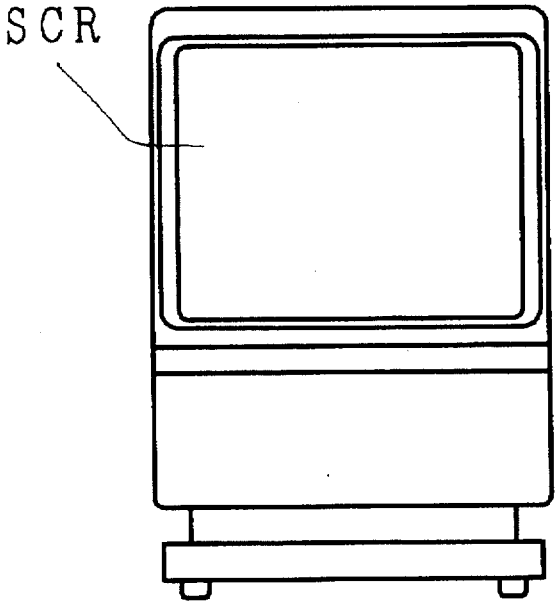
FIG. 21 is a schematic front view of a rear projection type TV receiver using a projection type cathode ray tube.
Figure 22:
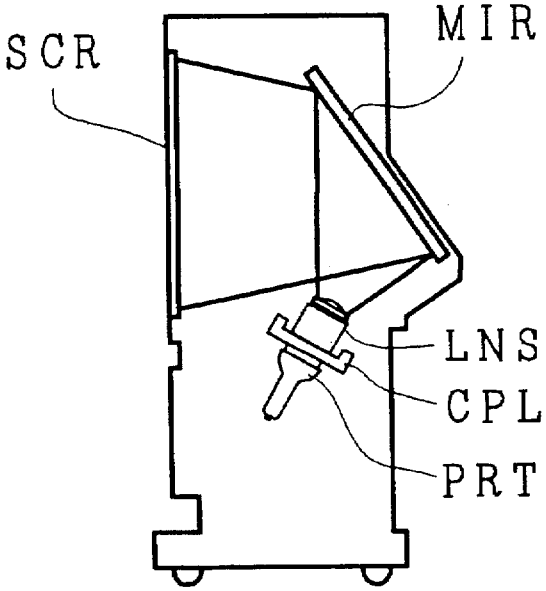
FIG. 22 is a schematic side view of the rear projection type TV receiver in FIG. 21 viewing from the lateral side.
Figure 23:
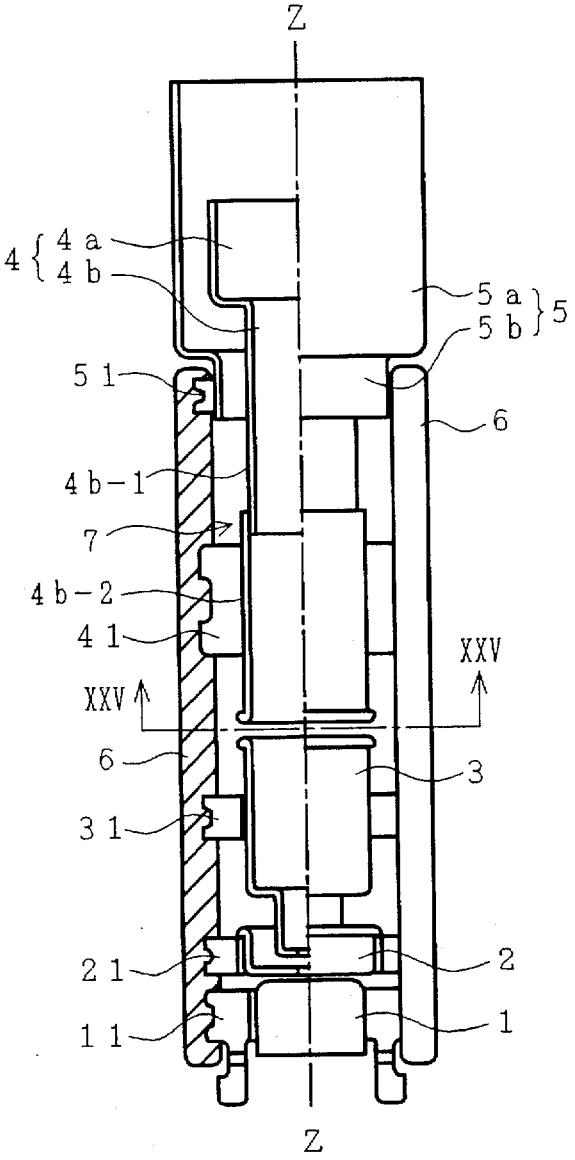
FIG. 23 (PRIOR ART)
FIG. 23 is a side view with essential portions cutaway explaining a configuration of an electron gun in the prior art.
Figure 24:
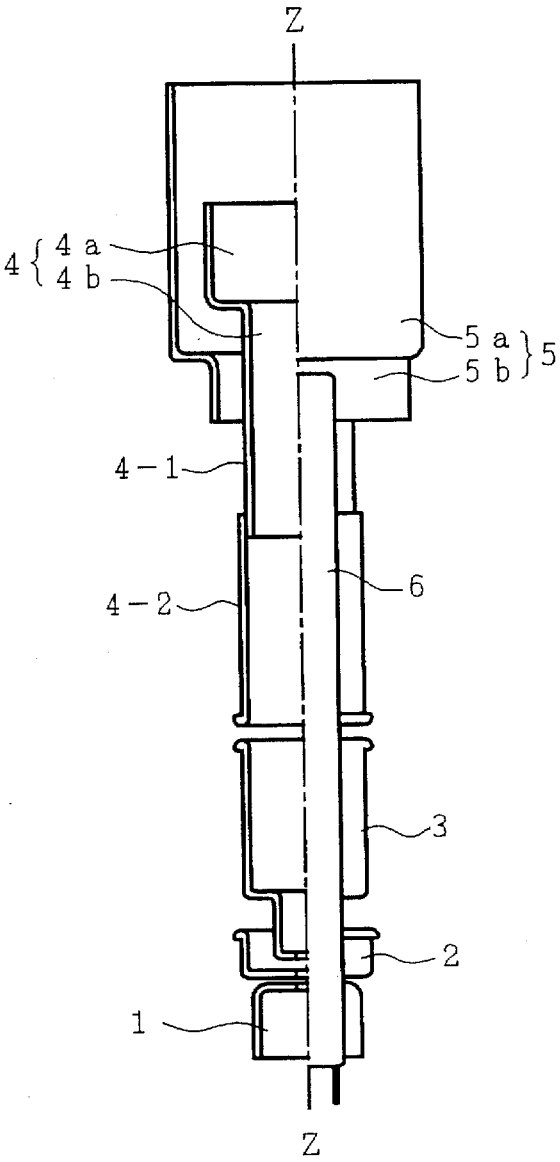
FIG. 24 (PRIOR ART)
FIG. 24 is a side view with essential portions cutaway showing the electron gun in FIG. 23 rotated by 90 degrees around the tube axis direction Z—Z.
Figure 25:
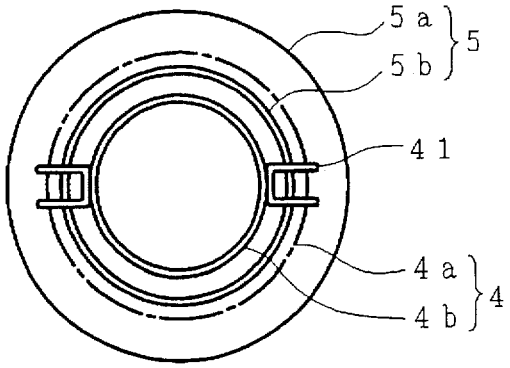
FIG. 25 (PRIOR ART)
FIG. 25 is a sectional view of the electron gun taken on XXV—XXV in FIG. 23.
Figure 26:
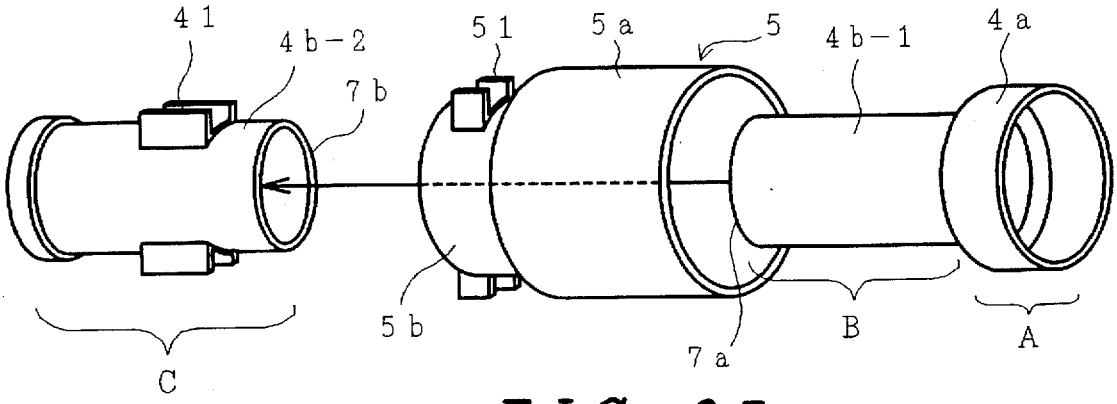
FIG. 26 (PRIOR ART)
FIG. 26 is an explanation diagram of assembling work of a large-diameter cylinder electrode and a small-diameter cylinder electrode.
Figure 27:
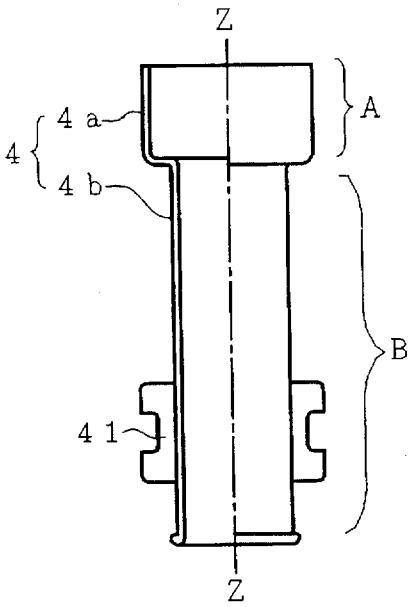
FIG. 27 (PRIOR ART)
FIG. 27 is a side view partly in section showing another configuration example of a small-diameter cylinder electrode in the prior art.

FIG. 21 is a schematic front view of a rear projection type TV receiver using a projection type cathode ray tube, and FIG. 22 is a schematic sectional side view of FIG. 21.

In FIG. 22, a projection lens LNS is mounted on a panel of the projection type cathode ray tube PRT installed below a projection type TV set through a coupler CPL (corresponding to 14 in FIG. 17) , and an image formed on the panel of the cathode ray tube PRT is enlarged by the projection lens LNS and projected onto the screen SCR installed on the front by a mirror MIR installed at the rear.

According to a projection type TV receiver constituted as described above, a projection distance from the cathode ray tube to the screen can be substantially reduced, and an image reproduction apparatus thin in depth and compact can be constituted.

Since a cathode ray tube according to the present invention is used in such a projection type TV receiver, an image reproduction apparatus of high image quality can be obtained.

According to the present invention as described above, an electron gun can be assembled in the same assembling technology as that in the prior art, and high productivity can be maintained, and an electron lens is assembled by with precision, thereby a cathode ray tube of high quality having a large-diameter lens of high precision can be obtained.

Further according to an embodiment of the present invention, as a small-diameter cylinder electrode constituting a main lens of an electron gun, a medium-diameter portion not requiring so high precision is formed between a large-diameter electrode portion and an end portion, thereby a small-diameter electrode end portion of a small-diameter cylinder electrode is shortened and precision of the parts can be improved, not accompanied by the difficulty of the manufacturing work and also the assembling work of the electron gun becomes easy.

Since a small-diameter cylinder electrode is formed as a unitary component, the mechanical strength is improved and deformation during transporting the parts can be prevented, and an electron gun for a cathode ray tube having a large-diameter electron lens attaining high precision and high productivity can be obtained.

What is claimed is:

1. A cathode ray tube with an electron gun forming an electron lens, comprising:

a large-diameter cylinder electrode having a first large-diameter cylinder portion, and a first small-diameter cylinder portion continuously connected to said first large-diameter portion and extending in a tube axis direction;

a small-diameter cylinder electrode extending in the tube axis direction and having a second large-diameter cylinder portion with a diameter smaller than that of said first large-diameter cylinder portion, a second small-diameter cylinder portion with a diameter smaller than that of said first small-diameter cylinder portion, and a medium-diameter cylinder portion having a diameter smaller than that of said second large-diameter cylinder portion and larger than that of said second small-diameter cylinder portion and continuously connecting said second large-diameter cylinder portion and said second small-diameter cylinder portion;

said large-diameter cylinder electrode and said small-diameter cylinder electrode being supported in coaxial and electrically insulated relationship through electrode supports fixed to said first small-diameter cylinder portion and said second small-diameter cylinder portion respectively by electrically insulating rods, so that at least said second large-diameter cylinder portion of said small-diameter cylinder electrode is positioned within said first large-diameter cylinder portion, wherein a distance between ends of said electrode support fixed to an outer surface of said second small-diameter cylinder portion is larger than an inner diameter of said first small-diameter cylinder portion, and said first small-diameter cylinder portion has locally bulged portions with an inner diameter larger thereof than said distance between ends of said electrode support formed at a position angularly displaced from a position of said electrode support fixed to said first small-diameter cylinder portion around the tube axis.

2. A cathode ray tube as set forth in claim 1, wherein said small-diameter cylinder electrode is an integrally drawn component comprising said second large-diameter cylinder portion, said second small-diameter cylinder portion and said medium-diameter cylinder portion having an inner diameter smaller than that of said second large-diameter cylinder portion and larger than that of said second small-diameter cylinder portion and connecting said second large-diameter cylinder portion and said second small-diameter cylinder portion.

3. A cathode ray tube as set forth in claim 1, wherein said small-diameter cylinder electrode is an integrally drawn component comprising said second large-diameter cylinder portion, said second small-diameter cylinder portion and said medium-diameter cylinder portion having an outer diameter smaller than that of said second large-diameter cylinder portion and larger than that of said second small-diameter cylinder portion and connecting said second large-diameter cylinder portion and said second small-diameter cylinder portion.

4. A cathode ray tube with an electron gun forming an electron lens, comprising:

a large-diameter cylinder electrode having a first large-diameter cylinder portion, and a first small-diameter cylinder portion continuously connected to said first large-diameter portion and extending in a tube axis direction;

a small-diameter cylinder electrode extending in the tube axis direction and having a second large-diameter cylinder portion with a diameter smaller than that of said first large-diameter cylinder portion, a second small-diameter cylinder portion with a diameter smaller than that of said first small-diameter cylinder portion, and a medium-diameter cylinder portion having a diameter smaller than that of said second large-diameter cylinder portion and larder than that of said second small-diameter cylinder portion and continuously connecting said second large-diameter cylinder portion and said second small-diameter cylinder portion;

said large-diameter cylinder electrode and said small-diameter cylinder electrode being supported in coaxial and electrically insulated relationship through electrode supports fixed to said first small-diameter cylinder portion and said second small-diameter cylinder portion respectively by electrically insulating rods, so that at least said second large-diameter cylinder portion of said small-diameter cylinder electrode is positioned within said first large-diameter cylinder portion, wherein a distance between ends of said electrode support fixed to an outer surface of said second small-diameter cylinder portion is larger than an inner diameter of said first small-diameter cylinder portion in an arrangement direction of said electrode support fixed to said first small-diameter cylinder portion, and a cross-section of said first small-diameter cylinder portion is an oval or oblong shape having a major axis length larger than said distance between ends of electrode support, and said major axis is angularly displaced from the arrangement direction of said electrode support around the tube axis.

5. A cathode ray tube as set forth in claim 4, wherein the displaced angle of said major axis is about 90 degrees.

6. A cathode ray tube as set forth in claim 4, wherein said small-diameter cylinder electrode is an integrally drawn component comprising said second large-diameter cylinder portion, said second small-diameter cylinder portion and said medium-diameter cylinder portion having an inner diameter smaller than that of said second large-diameter cylinder portion and larger than that of said second small-diameter cylinder portion and connecting said second large-diameter cylinder portion and said second small-diameter cylinder portion.

7. A cathode ray tube as set forth in claim 4, wherein said small-diameter cylinder electrode is an integrally drawn component comprising said second large-diameter cylinder portion, said second small-diameter cylinder portion and said medium-diameter cylinder portion having an outer diameter smaller than that of said second large-diameter cylinder portion and larger than that of said second small-diameter cylinder portion and connecting said second large-diameter cylinder portion and said second small-diameter cylinder portion.

8. A cathode ray tube with an electron gun forming an electron lens, comprising:

a large-diameter cylinder electrode having a first large-diameter cylinder portion, and a pair of electrode support portions continuously connected to the bottom surface of said first large-diameter cylinder portion and extending in the tube axis direction;

a small-diameter cylinder electrode extending in the tube axis direction and having a second large-diameter cylinder portion with a diameter smaller than that of said first large-diameter cylinder portion, a second small-diameter cylinder portion with a diameter smaller than an inner diameter of said pair of electrode support portions, and a medium-diameter cylinder portion having a diameter smaller than that of said second large-diameter cylinder portion and larger than that of said second small-diameter cylinder portion and continuously connecting said second large-diameter cylinder portion and said second small-diameter cylinder portion;

said large-diameter cylinder electrode and said small-diameter cylinder electrode being supported in coaxial and electrically insulated relationship through electrode supports fixed to said pair of electrode support portions and said second small-diameter cylinder portion by electrically insulating rods, so that at least said second large-diameter cylinder portion of said small-diameter cylinder electrode is positioned within said first large-diameter cylinder portion, wherein a distance between ends of said electrode supports fixed to an outer surface of said second small-diameter cylinder portion is larger than an inner diameter of said pair of electrode support portions, and an opening having a diameter larger than said distance between ends of an angularly displaced position from an arrangement direction of the pair of electrode support portions around the tube axis is formed at a bottom portion of said first large-diameter cylinder portion.

9. A cathode ray tube as set forth in claim 8, wherein said electrode support portions are formed by drawing integrally from said bottom portion of said large-diameter cylinder electrode.

10. A cathode ray tube as set forth in claim 8, wherein said small-diameter cylinder electrode is an integrally drawn component comprising said second large-diameter cylinder portion, said second small-diameter cylinder portion and said medium-diameter cylinder portion having an inner diameter smaller than that of said second large-diameter cylinder portion and larger than that of said second small-diameter cylinder portion and connecting said second large-diameter cylinder portion and said second small-diameter cylinder portion.

11. A cathode ray tube as set forth in claim 8, wherein said small-diameter cylinder electrode is an integrally drawn component comprising said second large-diameter cylinder portion, said second small-diameter cylinder portion and said medium-diameter cylinder portion having an outer diameter smaller than that of said second large-diameter cylinder portion and larger than that of said second small-diameter cylinder portion and connecting said second large-diameter cylinder portion and said second small-diameter cylinder portion.

12. A cathode ray tube having a tube axis with an electron gun, wherein a plurality of electrodes including a cathode, a first grid, a focus electrode and an accelerating electrode are arranged in a tube axis direction at prescribed intervals, and an electrode support fixed at a side wall of each electrode is embedded in a bead glass and fixed, wherein said electron gun comprises a large-diameter cylinder electrode having a first large-diameter cylinder portion and a first small-diameter cylinder portion, and a small-diameter cylinder electrode having a second large-diameter cylinder portion and a second small-diameter cylinder portion, extending in the tube axis direction, at least the second large-diameter cylinder portion of the small-diameter cylinder electrode is disposed in said first large-diameter cylinder portion of the large-diameter cylinder electrode and coaxially with said tube axis so that a main lens is formed, and said second small-diameter cylinder portion is an integrally drawn component comprising said second large-diameter cylinder portion, said second small-diameter cylinder portion and a medium-diameter cylinder portion having an inner diameter smaller than that of said second large-diameter cylinder portion and larger than that of said second small-diameter cylinder Portion and connecting said second large-diameter cylinder portion and said second small-diameter cylinder portion, and an end of said second small-diameter cylinder portion forms another electron lens in cooperation with an electrode disposed upstream of and facing said small-diameter cylinder electrode.

* * * * *